US005548880A

United States Patent [19]

Harb

[11] Patent Number: 5,548,880

[45] Date of Patent: Aug. 27, 1996

[54] BURIAL COMPARTMENT

[76] Inventor: Mitchell A. Harb, Lexington, N.C.

[21] Appl. No.: 501,868

[22] Filed: Jul. 13, 1995

[51] Int. Cl.[6] ..... A61G 17/00

[52] U.S. Cl. ..... 27/2; 27/26

[58] Field of Search ..... 27/1–2, 26–30

[56] References Cited

U.S. PATENT DOCUMENTS

| | | |
|---|---|---|
| 2,009,724 | 7/1935 | Bircher . |
| 3,654,676 | 4/1972 | McHugh . |
| 3,997,949 | 12/1976 | Waltz . |
| 4,237,590 | 12/1980 | Work . |
| 4,823,448 | 4/1989 | Martin . |
| 4,962,574 | 10/1990 | Estes . |
| 5,161,288 | 11/1992 | Chatman . |

FOREIGN PATENT DOCUMENTS

| | | |
|---|---|---|
| 562957 | 12/1957 | Belgium . |
| 40 37 645 | 5/1992 | Germany . |
| 94/03139 | 2/1994 | WIPO . |

*Primary Examiner*—Carl D. Friedman
*Assistant Examiner*—Beth A. Aubrey
*Attorney, Agent, or Firm*—Richard C. Litman

[57] ABSTRACT

A burial compartment for two bodies comprises an outer container and two inner containers separated by two inner panels and a center panel. The burial compartment is configured so as to provide for burial of two bodies in a burial plot dimensioned for only one person. Moreover, the burial compartment makes it possible to provide a sealed inner container for a first, single body until subsequently a second body is placed with the first, at which time two separate inner containers holding the two bodies are easily joined, allowing for eternal rest of two bodies in a single, unified compartment. A method of non-contemporaneous burial is also provided.

15 Claims, 5 Drawing Sheets

BURIAL COMPARTMENT

BACKGROUND OF THE INVENTION

1. Field of the Invention

The present invention relates to burial compartments, and more specifically to dual-coffin burial compartments.

2. Description of the Prior Art

While other cultures in past periods of history often considered burning or some other technique to be the most desirable way to take care of bodies of persons who had died, burying of dead bodies is the most common practice here and now. For this reason and because of the limited amount of land available for burial grounds, plots at burial grounds are typically sold at a premium, when they are available at all. In response to this demand for burial space, various attempts have been made to improve upon the conventional coffin. No such attempt, however, succeeds in providing a dual burial compartment that is so easy and effective to use as the present invention.

U.S. Pat. No. 2,009,724, issued to Eugene A. Bircher, on Jul. 30, 1935, shows an ash-receptacle shaped like a book. There is no space in this receptacle for bodies, and no removable partitions for selectively separating and joining body compartments.

U.S. Pat. No. 3,654,676, issued to Wilfred Lewis McHugh, on Apr. 11, 1972, shows a casket capsule having a reusable outer casket and a single-use inner casket. There is no showing in this patent of removable partitions for selectively separating and joining multiple body compartments.

U.S. Pat. No. 3,997,949, issued to Maynard W. Waltz, on Dec. 21, 1976, shows caskets and vaults for use in side-by-side burials. There is no showing in this patent of removable partitions for selectively separating and joining multiple body compartments.

U.S. Pat. No. 4,237,590, issued to Gerald L. Work, on Dec. 9, 1980, shows a casket system having a reusable, false, outer casket and a single-use inner casket. There is no showing in this patent of removable partitions for selectively separating and joining multiple body compartments.

U.S. Pat. No. 4,823,448, issued to Clarence G. Martin, on Apr. 25, 1989, shows a removable casket cover. There is no showing in this patent of removable partitions for selectively separating and joining multiple body compartments.

U.S. Pat. No. 4,962,574, issued to John W. Estes, on Oct. 16, 1990, shows a casket having multiple display capabilities. There is no showing in this patent of removable partitions for selectively separating and joining multiple body compartments.

U.S. Pat. No. 5,161,288, issued to Charles Chatman, on Nov. 10, 1992, shows a multi-occupancy casket. There is no showing in this patent of removable partitions for selectively separating and joining multiple body compartments, in the manner of the present invention.

Belgium Patent Document No. 562,957, registered on Dec. 31, 1957, shows a single-body burial compartment. There is no showing in this patent of removable partitions for selectively separating and joining multiple body compartments.

German Patent Document No. 40 37 645, issued on May 14, 1992, shows a re-usable casket cover to be placed over a casket. There is no showing in this patent of removable partitions for selectively separating and joining multiple body compartments.

PCT Patent Document No. 4/03139, issued on Feb. 17, 1994, shows a ceremonial outer casket and a re-usable inner coffin. The outer casket has lower, hinged members. There is no showing in this patent of removable partitions for selectively separating and joining multiple body compartments.

None of the above inventions and patents, taken either singly or in combination, is seen to describe the instant invention as claimed.

SUMMARY OF THE INVENTION

A dual-body burial compartment according to the present invention comprises an outer container and two inner containers. The inner containers include a primary container and a secondary container. The inner containers are separated by two inner provacy panels and a central panel. The burial compartment is configured so as to provide for burial of two bodies in a burial plot dimensioned for only one person. Moreover, the burial compartment makes it possible to provide a sealed container for a first, single body until subsequently a second body is placed with the first, at which time two separate containers holding the two bodies are easily joined, allowing for eternal rest of two bodies in a single, unified compartment. A method of non-simultaneous burial of two bodies using the dual-body burial compartment of the present invention is also provided.

Accordingly, it is a principal object of the invention to save space at a burial grounds.

It is another object of the invention to facilitate burial of partners near one another.

It is a further object of the invention to ensure sanctity of each body buried in a two-body burial compartment.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention saves space at a burial grounds by providing burial space for two persons, in a volume of space ordinarily used for a single body. Moreover, the present invention allows partners to be buried in a unified region of space, while at the same time ensuring that chronologically separated deaths will not disrupt the sanctity of either body.

Figure 1:
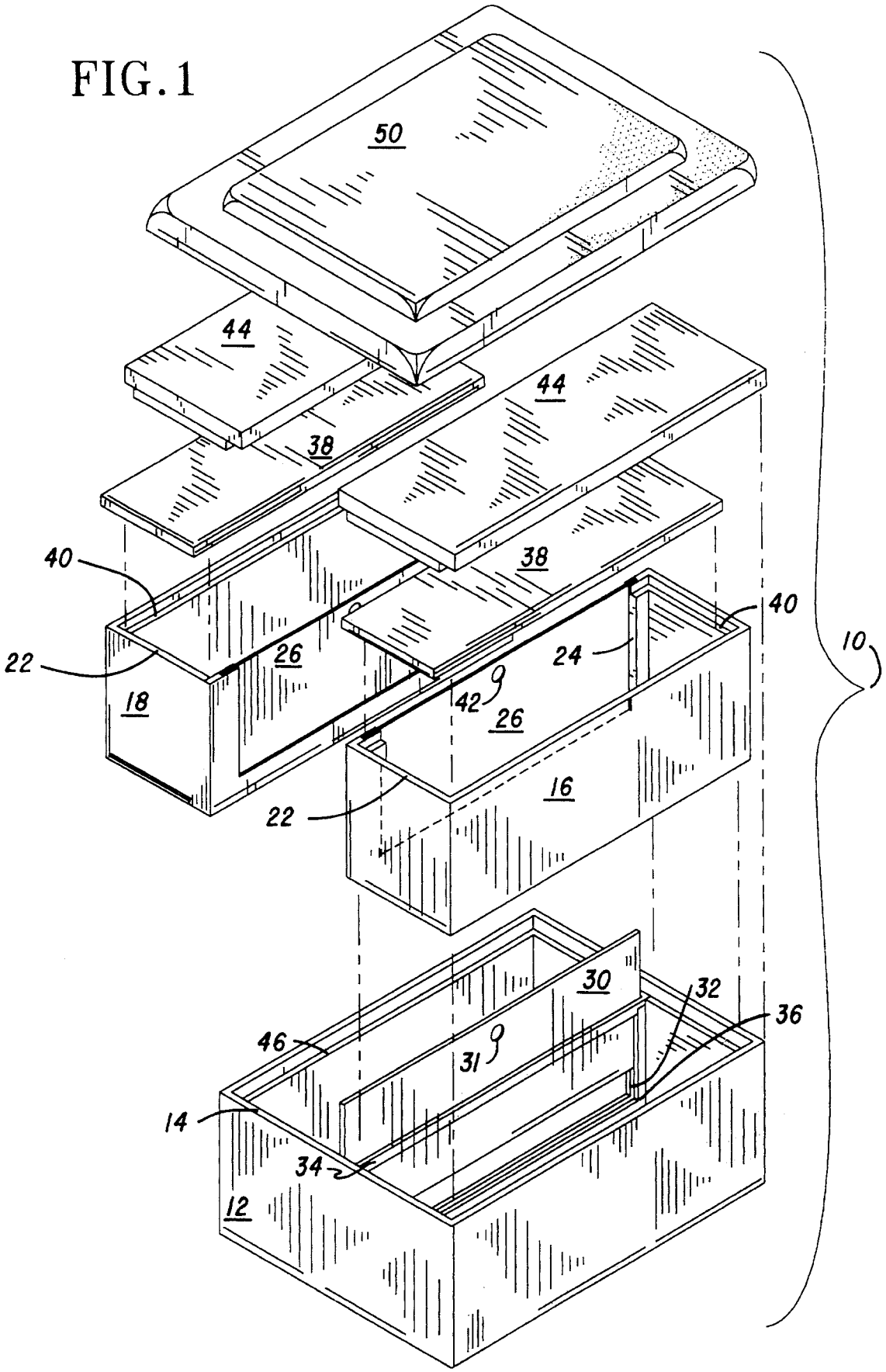
FIG. 1 shows an exploded, perspective view of a burial compartment according to the present invention.

Referring to the drawings, and particularly to FIG. 1 of the drawings, a burial compartment 10 according to the present invention comprises an outer container 12, preferably smaller in length and width than four feet by eleven feet, having an open top side 14; and two inner containers 16, 18 dimensioned and configured to contain an extended, supine body 20 and to wholly insert into the outer container 12. Each inner container 16, 18 has an open top side 22 and an open communication side 24. The inner containers 16, 18, although identical for practical purposes, are referenced herein for the sake of clarity as a primary container 16 and a secondary container 18. Each of the inner containers 16, 18 has one of two privacy panels 26 insertably received by privacy panel receiving slots 28 disposed around the open communication side 24 of the inner containers 16, 18. Insertion of a privacy panel 26 into the privacy panel receiving slots 28 effects closure of the open communication side 24. The inner containers 16, 18, when placed in the outer container 12 are separated by a central panel 30 having a gripping aperture 31 or handle of known type (not shown) and insertably received by central panel receiving slots 32 disposed in a stabilizing cross bar 34 and an elongated C-shaped panel receiving member 36 connected internally and centrally to the outer container 12.

There are two inner lids 38, each dimensioned and configured to fit on ledges 40 formed in top sides 22 of the inner containers 16, 18. The inner lids 38 have gripping apertures 42 or handles of known type (not shown). Importantly, the inner lids 38 do not block removal of the privacy panels 26 from the privacy panel receiving slots 28. There are also two outer lids 44A and 44B, each dimensioned and configured to fit, adjacent to one another, on ledges 46 formed in an upper side 14 of the outer container 12. One outer lid 44A does not block removal of the privacy panels 26, whereas the other outer lid 44B is wider and obstructs removal of the privacy panels 26. A sealing cover 50 is dimensioned and configured to fit over and seal the upper side 14 of the outer container 12.

Figure 3A:
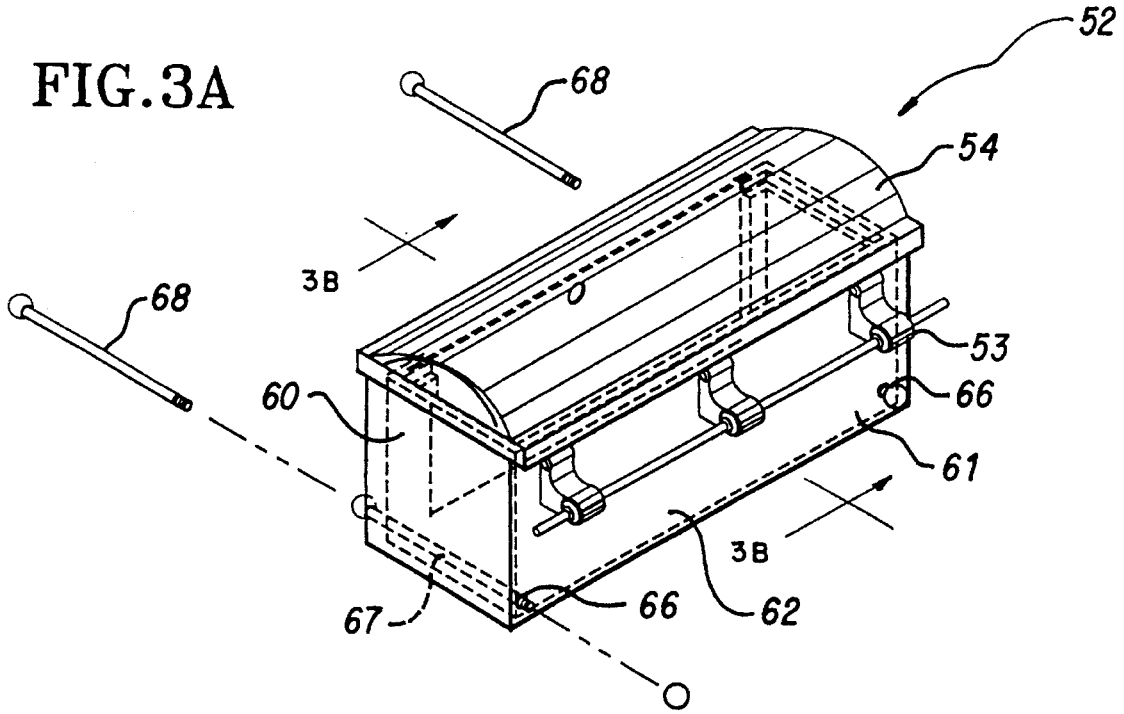
FIG. 3A shows a perspective view of an inner container and viewing shell used with the burial compartment according to the present invention.
Figure 3B:
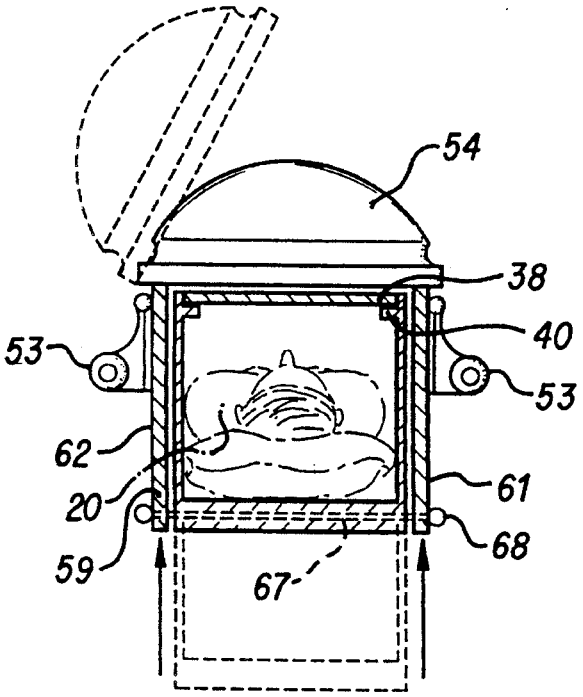
FIG. 3B shows a cross section view of an inner container and viewing shell used with the burial compartment according to the present invention.
Figure 4A:
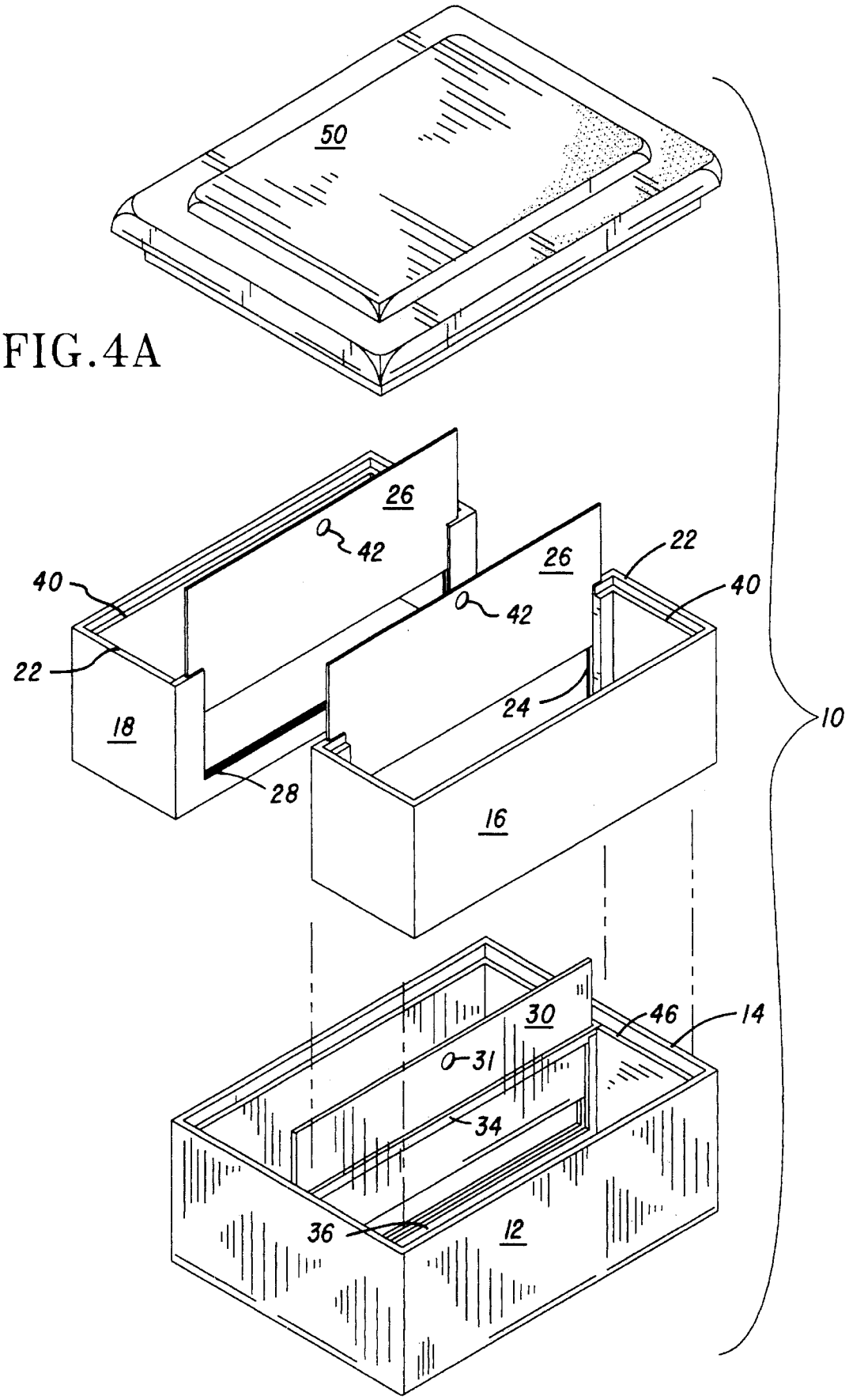
FIG. 4A shows an exploded, perspective view of the burial compartment according to the present invention, when configured for two bodies.
Figure 4B:
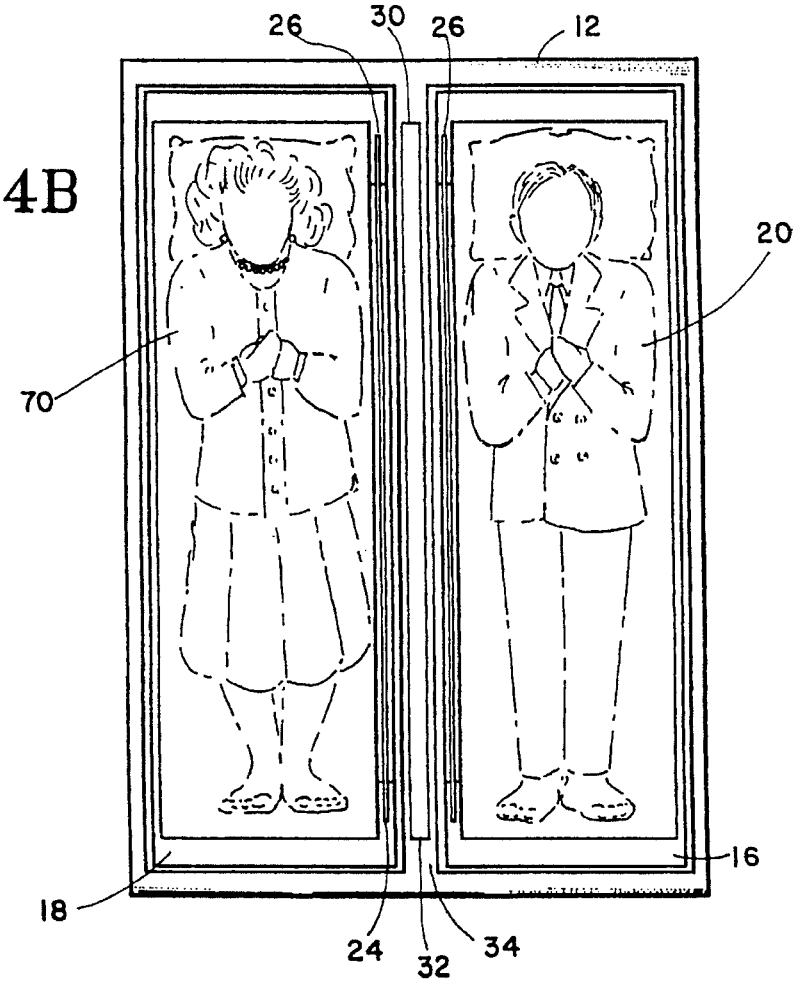
FIG. 4B shows a top plan view of the burial compartment according to the present invention, when holding two bodies.
Figure 4C:
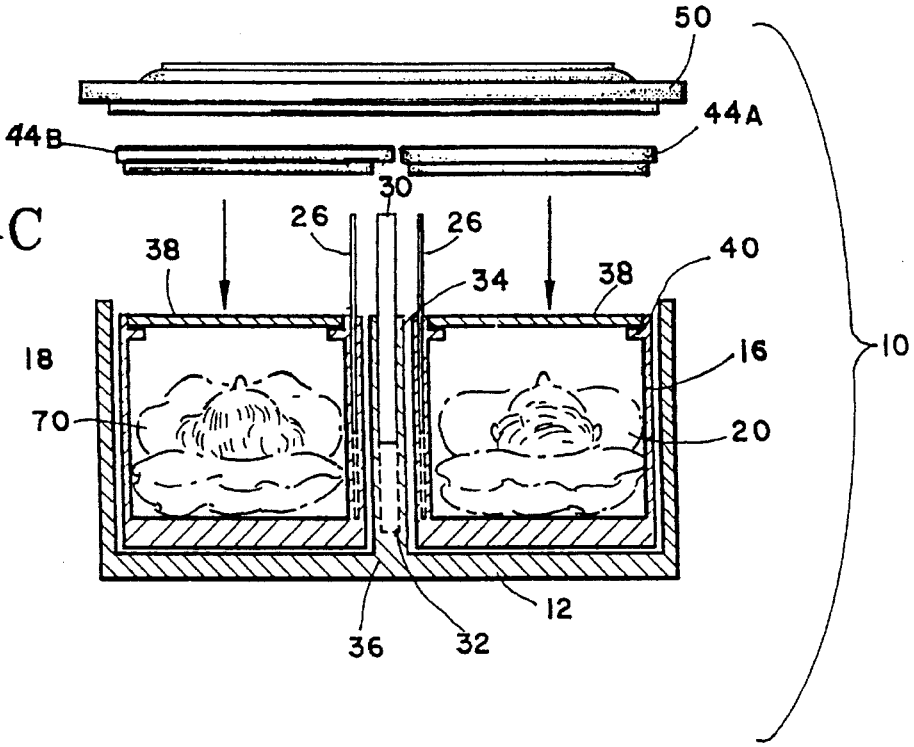
FIG. 4C shows a cross section view of the burial compartment according to the present invention, when holding two bodies.

There is a re-usable body viewing shell 52 dimensioned and configured to fit over and surround each of the inner containers 16, 18, one inner container 16, 18 at a time. Preferably, the viewing shell 52 has handles 53 with which to carry the viewing shell 52. The viewing shell 52 has a hinged lid 54 which may be opened or closed, an open nether region 56, an upper wall 58, an opposing lower wall 60, and two opposing side walls 62, each wall having bottom sides 59, 61 and 63, respectively. In the bottom sides 63 of the opposing side walls 62, there is a plurality of apertures 66 located immediately above the open nether region 56, each aperture 66 opposing another aperture 66. Each of a plurality support rods 68 is inserted through each aperture 66, so that each rod 68 projects into and through an opposing aperture 66. Rods 68 thus oriented support an inner container 16, 18 within the viewing shell 52, either by supporting the inner containers 16, 18 externally, or by insertion through bores 67 transversing the inner containers 16, 18, as shown in FIG. 3B.

Figure 2:
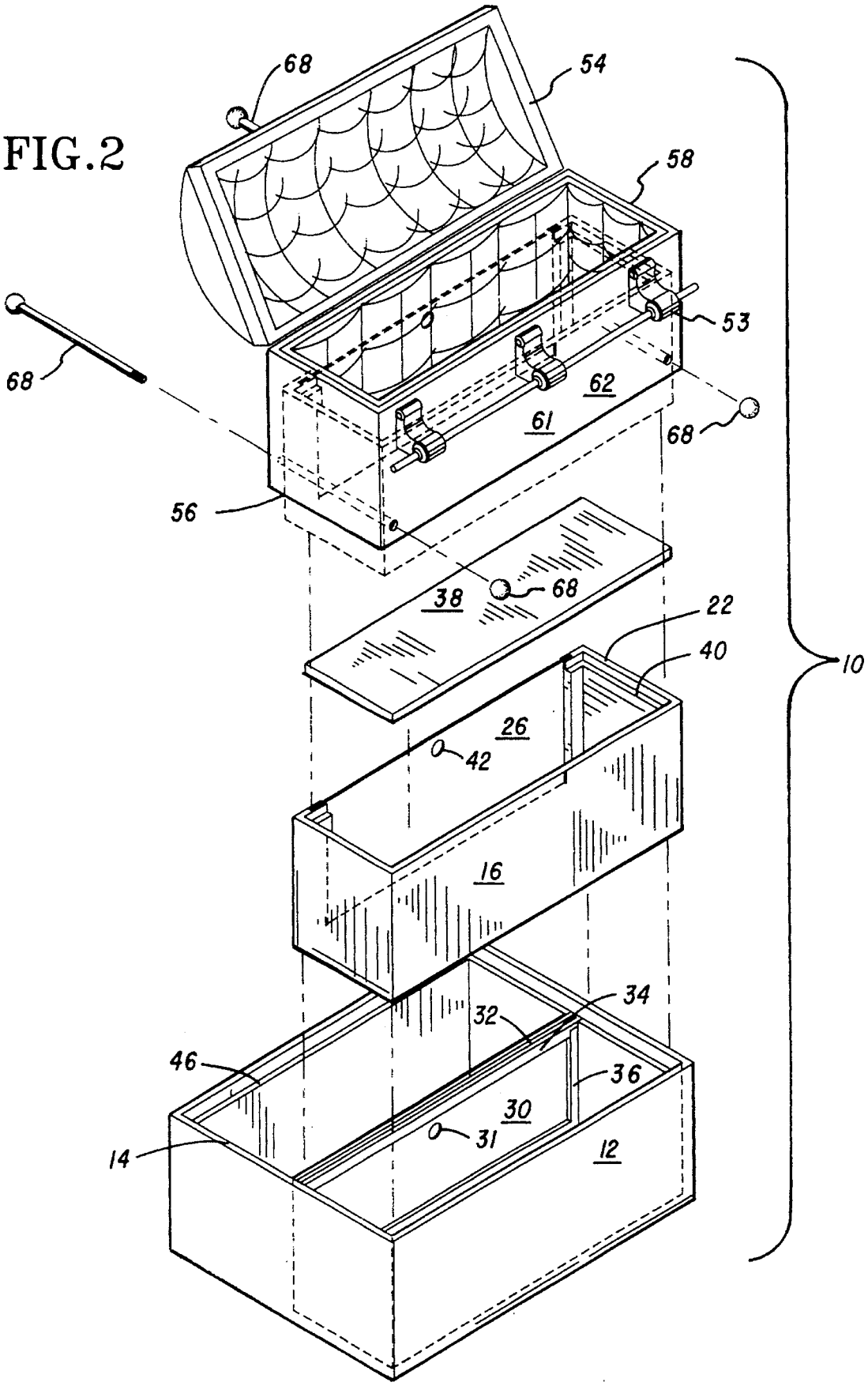
FIG. 2 shows an exploded, perspective view of a burial compartment according to the present invention, when configured for one body.

A method of using the burial compartment 10 according to the present invention includes the steps of inserting support rods 68 in opposing apertures 66 of a viewing shell 52, as above-described, and placing one of the inner containers 16, 18, such as the primary inner container 16, in the viewing shell 52, on the supporting rods 68, with the privacy panel 26 left in place in the privacy panel receiving slots 28. Alternately, the inner container 16 can be placed in the viewing shell 52 prior to insertion of the support rods 68, so that the support rods 68 project through the bores 67 in the inner container 16. Then, a worker places a first body 20 in the primary inner container 16, making sure that neither the inner lid 38 nor the outer lid 44 is yet in place. Then, the first body 20 is viewed in a conventional wake, with the viewing shell 52 in an open configuration, as shown in FIG. 2. The primary inner container 16 is then sealed by known means with one of the inner lids 38. Then, the first body 20 in the primary inner container 16 may be transported in the viewing shell 52 to a funeral site or the primary inner container 16 can be removed from the viewing shell 52 prior to transport of the body 20 to a funeral site.

At the funeral site, a hole is prepared in ground where the first body 20 is to be buried, and the outer container 12 is placed in the hole. Importantly, the hole need be no bigger than an area typically allowed for a single-body burial plot, namely, four feet by eleven feet. The primary inner container 16, containing the first body 20 is placed in the outer container 12, leaving the viewing shell 52 for re-use with the remaining inner container, i.e. the secondary inner container 16 as referred to herein. An outer lid 44A is placed over the primary inner container 16. The privacy panel 26 is removed from the privacy panel receiving slots 28 after the central panel 30 is inserted into the central panel receiving slots 32. The outer container 12 is then sealed by a sealing cover, by known means.

When a second body 70 is ready to be buried with the first body 20 a worker inserts support rods 68 in opposing apertures 66 of the viewing shell 52, as above-described, placing a remaining of the inner containers 16, 18, specifically being the secondary inner container 18 in this example, in the viewing shell 52, on the supporting rods 68, with the privacy panel 26 left in place in the privacy panel receiving slots 28. Then a worker places the second body 70 in the secondary inner container 18, making sure that neither the inner lid 38 nor the outer lid 44B is yet in place. Then, the second body 70 can be viewed in a conventional wake, with the viewing shell 52 in an open configuration, as in FIG. 2. The secondary inner container 18 is then sealed by known means with one of the inner lids 38. Then, the second body 70 in the secondary inner container 18 may be transported in the viewing shell 52 to a funeral site or the primary inner container 18 can be removed from the viewing shell 52 prior to transport of the second body 70 to a funeral site.

At the funeral site, the outer container 12 previously buried with the first body 20 is exposed and the sealing cover 50 and outer lid 44 are removed. Importantly, the sanctity of the first body 20 is not disturbed by this step inasmuch as the first body 20 is protected by the inner lid 38, the privacy panel 26, and the central panel 30. The secondary inner container 18, containing the second body 70 is placed in the outer container 12 next to the primary inner container 16, separated from the primary inner container 16 only by the stabilizing cross bar 34, the elongated C-shaped panel receiving member 36, and central panel 30, if present. The viewing shell 52 remains for further re-use with another inner container not part of the burial compartment used for the described bodies 20, 70.

In order to unify the burial space occupied by the bodies 20, 70, the privacy panel 26 in each inner container 16, 18 is removed, as is the central panel 30. These panels 26, 30 can be saved for use with other burial compartments 10 or discarded. The outer lid 44B is placed over the two inner compartments 18, and the sealing cover 50 is replaced. Finally, the burial compartment 10 is again interred. Notably, the hole need not be enlarged for the second body 70 beyond an area typically allowed for a single-body burial plot, namely, four feet by eleven feet. This circumstance exists because both bodies 20, 70 are fully contained in the outer container 12, which is smaller than four feet by eleven feet.

By the apparatus and method above-described, two bodies can conveniently be buried in the space normally allotted to a single body. Yet, the sanctity of each body can be preserved despite different times of death, and the burial space of the bodies can be unified once the second body is buried.

It is to be understood that the present invention is not limited to the sole embodiment described above, but encompasses any and all embodiments within the scope of the following claims.

I claim:

1. A burial compartment for two bodies, comprising:

a first inner container and a second inner container, each inner container being dimensioned and configured to contain a supine body, each inner container having an open top side, inner lid receiving ledges disposed in said top side, an open communication side, and privacy panel receiving slots disposed in said open communication side;

two privacy panels slidably insertable into said privacy panel receiving slots;

two inner lids dimensioned and configured to engage said lid receiving ledges in said inner containers, thereby covering said open top side of each of said inner containers;

an outer container dimensioned and configured to hold and surround said inner containers, said outer container having an open top side and outer lid receiving ledges disposed in said top side of said outer container;

two outer lids dimensioned and configured to fit together in said outer lid receiving ledges, thereby covering said open top side of said outer container;

a stabilizing cross bar and an elongated C-shaped panel receiving member connected internally and centrally to the outer container, said stabilizing cross bar and said panel receiving member having central panel receiving slots disposed therein; and a central panel dimensioned and configured to slidably insert into said central panel receiving slots.

2. The burial compartment according to claim 1, further including:

a body viewing shell having an upper wall, an opposing lower wall, and two opposing side walls, each wall having a bottom side;

a plurality of apertures in said opposing side walls, each of said apertures opposing another of said apertures; and a plurality support rods inserted through each of said apertures, and projecting into and through an opposing one of said apertures.

3. A body viewing shell comprising:

an upper wall;

an opposing lower wall parallel to and spaced from said upper wall;

two opposing side walls;

each of said upper, lower, and side walls having a bottom side;

an open nether region defined and bounded by said bottom side of each said upper, lower, and side walls;

a plurality of apertures in said bottom sides of said opposing side walls immediately above said open nether region, each of said apertures opposing another of said apertures; and a plurality support rods inserted through each of said apertures, and projecting into and through an opposing one of said apertures.

4. A method of burying two bodies at disparate times, comprising the steps of:

obtaining a first inner container and a second inner container, each inner container being dimensioned and configured to contain a supine body, each inner container having bores transversing the inner container, each inner container further having an open top side, inner lid receiving ledges disposed in the top side, an open communication side, and privacy panel receiving slots disposed in the open communication side, two privacy panels slidably insertable into the privacy panel receiving slots, two inner lids dimensioned and configured to engage the lid receiving ledges in the inner containers, thereby covering the open top side of each of the inner containers;

obtaining an outer container dimensioned and configured to hold and surround the inner containers, the outer container having an open top side and outer lid receiving ledges disposed in the top side of the outer container, two outer lids dimensioned and configured to fit together in the outer lid receiving ledges, thereby covering the open top side of the outer container, a stabilizing cross bar and an elongated C-shaped panel receiving member connected internally and centrally to the outer container, the stabilizing cross bar and the panel receiving member having central panel receiving slots disposed therein, a central panel dimensioned and configured to slidably insert into the central panel receiving slots;

obtaining a body viewing shell having an upper wall, an opposing lower wall, and two opposing side walls, each wall having a bottom side, a plurality of apertures in the opposing side walls, each of the apertures opposing another of the apertures, and a lid which may be selectively opened and closed;

placing a first body in the first inner container;

viewing the first body in a conventional wake, with the viewing shell in an open configuration;

sealing the first inner container with one of the inner lids;

transporting the first body in the inner container in the viewing shell to a funeral site;

preparing a hole in ground where the first body is to be buried;

placing the outer container in the hole;

placing the first inner container, containing the first body, in the outer container;

placing an outer lid over the first inner container; and sealing the outer container with a sealing cover.

5. The method of burying two bodies at disparate times, according to claim 4, further comprising the steps of:

placing a second body in the second inner container;

viewing the second body in a conventional wake, with the viewing shell in an open configuration;

sealing the second inner container with one of the inner lids;

transporting the second body in the inner container in the viewing shell to a funeral site;

exposing the outer container;

removing the sealing cover and the outer lid from the outer container; and placing the second inner container, containing the second body in the outer container, next to the first inner container containing the first body.

6. The method of burying two bodies at disparate times, according to claim 5, further comprising the steps of:

removing the privacy panel from the privacy panel receiving slots in each inner container;

placing the outer lids on the two inner compartments;

replacing the sealing cover; and re-interring the burial compartment.

7. The method of burying two bodies at disparate times, according to claim 4, further comprising the step of removing the inner container from the viewing shell prior to transport of the body to a funeral site.

8. The method of burying two bodies at disparate times, according to claim 4, further comprising the step of ensuring that the hole be no bigger than an area of four feet by eleven feet.

9. The method of burying two bodies at disparate times, according to claim 4, further comprising the step of ensuring that the central panel is inserted into the central panel receiving slots after said step of placing the first inner container, containing the first body, in the outer container, and before said step of placing an outer lid over the first inner container.

10. The method of burying two bodies at disparate times, according to claim 9, further comprising the step of removing the central panel from the central panel receiving slots subsequent to inserting the central panel into the central panel receiving slots.

11. The method of burying two bodies at disparate times, according to claim 6, further comprising the step of selectively saving each panel to use with another burial compartment and discarding each panel, after said step of removing each panel from the panel receiving slots.

12. The method of burying two bodies at disparate times, according to claim 4, further comprising the steps of:

immediately before said step of placing a first body in the inner container, inserting the support rods in opposing apertures of the viewing shell; and placing one of the inner containers in the viewing shell, on the supporting rods, with the privacy panel left in place in the privacy panel receiving slots.

13. The method of burying two bodies at disparate times, according to claim 4, further comprising the steps of:

immediately before said step of placing a first body in the inner container, placing one of the inner containers in the viewing shell, on the supporting rods, with the privacy panel left in place in the privacy panel receiving slots; and inserting the support rods in opposing apertures of the viewing shell and the bores of the inner container.

14. The method of burying two bodies at disparate times, according to claim 5, further comprising the steps of:

immediately before said step of placing a second body in the second inner container, inserting support rods in opposing apertures of the viewing shell; and placing the second inner container in the viewing shell, on the supporting rods, with the privacy panel left in place in the privacy panel receiving slots.

15. The method of burying two bodies at disparate times, according to claim 5, further comprising the steps of:

immediately before said step of placing a second body in the second inner container, placing the second inner container in the viewing shell, on the supporting rods, with the privacy panel left in place in the privacy panel receiving slots; and inserting support rods in opposing apertures of the viewing shell and bores in the second inner container.

* * * * *